United States Patent [19]

Frank

[11] Patent Number: 4,457,107

[45] Date of Patent: Jul. 3, 1984

[54] PUSH BAR FITTING TO BE INTRODUCED INTO A LONGITUDINAL GROOVE OF THE FRAME OF A WINDOW, DOOR, OR THE LIKE

[75] Inventor: Wilhelm Frank, Leinfelden-Echterdingen, Fed. Rep. of Germany

[73] Assignee: Wilhelm Frank GmbH, Fed. Rep. of Germany

[21] Appl. No.: 357,337

[22] Filed: Mar. 11, 1982

[30] Foreign Application Priority Data

Mar. 11, 1981 [DE] Fed. Rep. of Germany ..... 3109107

[51] Int. Cl.[3] ..... E05D 15/52

[52] U.S. Cl. ..... 49/192

[58] Field of Search ..... 49/192

[56] References Cited

FOREIGN PATENT DOCUMENTS 2261946 12/1972 Fed. Rep. of Germany ..... 49/192

2067638 7/1981 United Kingdom ..... 49/192

*Primary Examiner*—Kenneth Downey

*Attorney, Agent, or Firm*—McGlew and Tuttle

[57] ABSTRACT

Push bar fittings which extend in longitudinal grooves of the frames of windows, doors, or the like, are provided with holding means by which ribs projecting from the side walls of the groove are engaged from below, with the push bar being mounted for displacement above the ribs. To provide as wide a range as possible for cutting the push bar to length, and, on the other hand, to obtain a good guidance of the push bar ends in spite of that, the push bar is provided at the level of the ribs with a portion correspondingly sloping toward the groove bottom. Consequently, the free end of the push bar then extends in the groove portion below the ribs and is thus prevented from moving out of the longitudinal groove.

4 Claims, 1 Drawing Figure

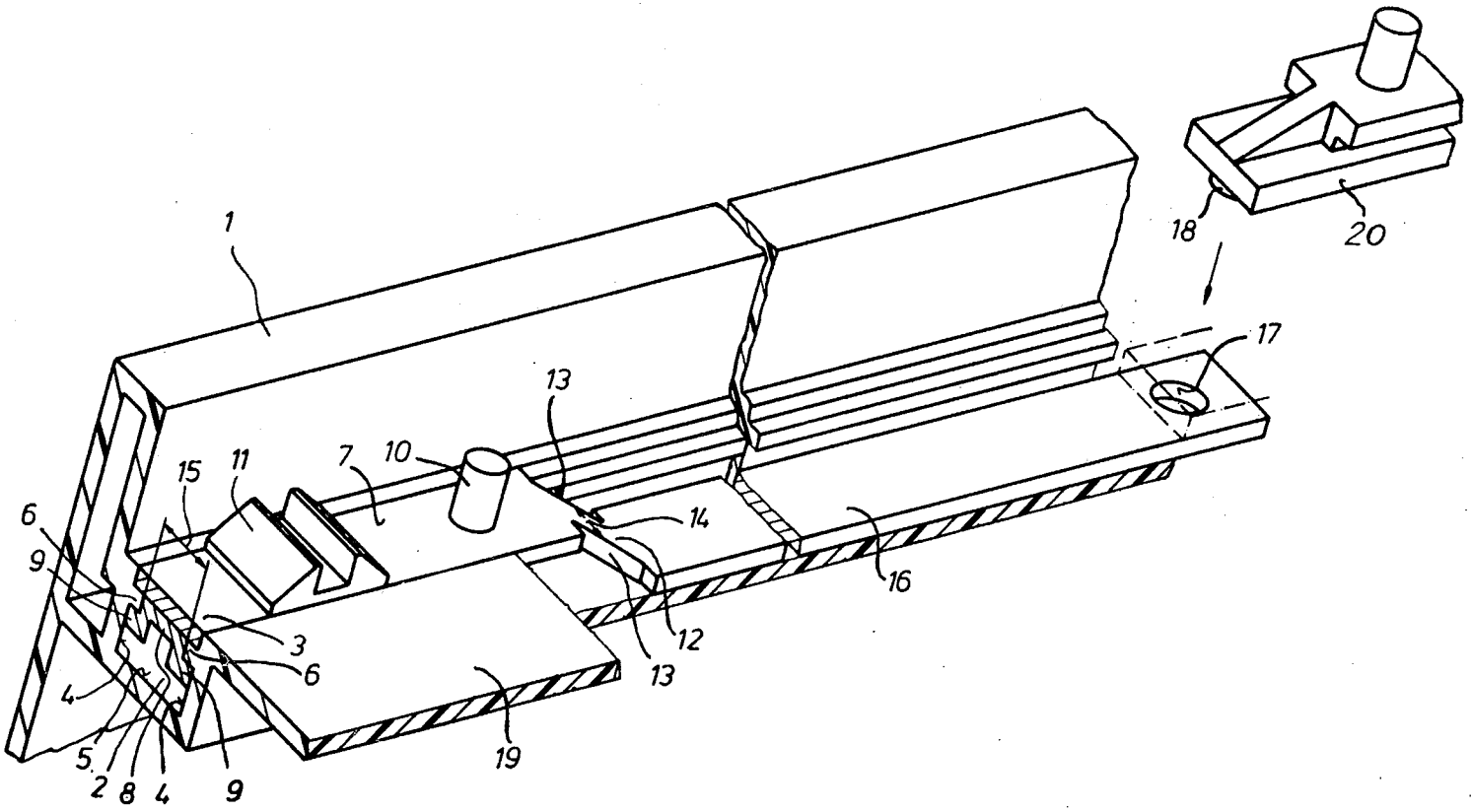
20
18
17
16
14
12
13
13
19
10
7
1
11
15
3
6
9
4
8
2
5
4
6
9

PUSH BAR FITTING TO BE INTRODUCED INTO A LONGITUDINAL GROOVE OF THE FRAME OF A WINDOW, DOOR, OR THE LIKE

FIELD AND BACKGROUND OF THE INVENTION

It is known from German utility model No. 75 37 867 to provide the longitudinal groove for guiding a push bar of a window or door frame, with ribs which extend at a distance from the rabbet surface and project from side walls of the longitudinal groove. In this prior art design, the push bar is mounted for displacement and rests in the upper groove portion against the front or top side of the ribs and is provided with holding means which engage the back or bottom side of the ribs from below, at uniformly spaced locations.

In order to adjust to definite wing sizes or to other fittings to be connected, it is necessary to cut the push bars to size. In such instances it may happen that the cut is made close behind a holding member, so that this member remains on the remnant cutoff and a great length of the push bar is no longer secured against lifting. Then, if a locking member is provided at the free end of the push bar, for example, a risk is run that under the relatively strong forces exerted to close the window and due to the unsatisfactory hold, the push bar will bend in the groove, and a secure locking is no longer ensured. If another push bar is provided instead of or in addition to the locking pin, a further risk is run that because of the bending, the two parts will disengage. Bridge-like covers might be provided as a remedy, however, these are additional parts which, in addition, must be mounted separately.

SUMMARY OF THE INVENTION

The present application is directed to a slide-lock fitting comprising push bars which are securely held in the groove at their free ends without additional component parts and allow cutting of the push bars to proper lengths within a wide range. In accordance with the invention, this is achieved by designing the push bar with a sloping portion which slants toward the groove bottom and is provided in the zone of the ribs with recesses which are spaced from each other by a distance which is smaller than the clear width between the ribs. Consequently, in the zone of the free end of the push bar, the holding means is formed by the push bar itself, so that additional holding means can be omitted. In this way, the drawbacks of the prior art, namely the bending out of the push bar with unfavorable consequences such as disengaging of connections and unsatisfactory locking, are completely eliminated. Also, a relatively wide range for cutting the bar to length is available.

It is true that in channel rails, such as shown in German utility model No. 74 10 711, it is known to provide sloping portions which extend down to the bottom of the channel or groove, however, such grooves or rails do not exhibit features which would prevent the rail from being lifted upwardly. For fixing the rail, screws in the groove bottom are rather necessary in this design, which, at the same time, prevent a displacement of the rail in the longitudinal direction. This is another underlying problem and an entirely different solution.

BRIEF DESCRIPTION OF THE DRAWING

The drawing shows an embodiment of the invention in a cut-away and partial view of a frame part with a push bar.

DETAILED DESCRIPTION OF THE PREFERRED EMBODIMENT

In a frame 1 made of plastic, a longitudinal groove 2 is provided, serving as a guideway for a push bar 3. Ribs 6 project from the side walls 4 of the groove at a distance from the groove bottom 5 and from a rabbet surface 19, which ribs reduce the cross section of longitudinal groove 2, to a width 15. The push bar portion 7 extending above ribs 6 is secured against lifting by a holding member 8 connected to portion 7. The holding member is U-shaped, with the outwardly angled legs 9 engaging ribs 6 from below. Above portion 7, a locking bolt 10 and an engaging member 11 for connecting further parts of the fitting are provided.

Adjacent bar portion 7, a sloping portion 12 is provided which slants toward the groove bottom 5 and, in the zone of ribs 6, has recesses 13 which are spaced from each other by a distance 14 which is smaller than the clear width 15 between ribs 6. In consequence, the push bar portion 16 adjacent to sloping portion 12 extends in the lower portion of longitudinal groove 2 and is prevented by ribs 6 from being lifted perpendicularly from the bottom 5 of the longitudinal groove. Push bar portion 16 is provided with a thru hole 17 intended to be engaged with a pin of a fitting part 20 to be coupled thereto, such as the engaging member of a corner fitting, or another push bar. Upon coupling fitting part 20 to push bar portion 16, the portion of longitudinal groove 2 extending between rib 6 and groove bottom 5 is filled out by the fitting part 20, so that an unintentional uncoupling is prevented and a reliable guidance is obtained. Since push bar portion 16 cannot move out of the lower portion of the groove, a great extension of the push bar portion 16 can be provided, in order to ensure a long range for cutting the push bar to length.

I claim:

1. A push bar for the frame of a window or door having a longitudinal groove and including a rabbet surface, the frame including side walls defining the longitudinal groove and having ribs extending from the side walls toward each other, the ribs spaced from the rabbet surface, comprising, a first push bar portion mounted for displacement along the groove and resting on an upper side of the ribs, holding means connected to said first push bar portion and engaged with a lower surface of the ribs for holding said first push bar portion to the ribs, a sloping portion of the push bar connected to said first push bar portion and extending downwardly into the groove toward a bottom of the groove, and a second push bar portion connected to said sloping portion and extending in the longitudinal groove below the ribs, said push bar having at least one recess in said sloping portion thereof for reducing said sloping portion to a width which is at most less than the spacing between the ribs whereby said second push bar portion is attained in the longitudinal groove below the ribs.

2. A push bar according to claim 1, wherein said sloping portion includes a pair of recesses on opposite sides thereof and each in the vicinity of one of the ribs.

3. A push bar according to claim 2, wherein said holding means comprises a U-shaped member connected to a lower surface of said first push bar portion having an upper part at most equal to the spacing between the ribs and lower flange portions extending outwardly in the groove for engaging a lower surface of the ribs.

4. A push bar according to claim 3, including a fitting member connected to an end of said second push bar portion remote from said first push bar portion, said fitting member having recesses for receiving the ribs, said fitting member connected to an upper surface of said second push bar portion for retaining said push bar portion adjacent the bottom of the groove.

* * * * *